United States Patent [19]

Mannaerts

[11] 4,005,799

[45] Feb. 1, 1977

[54] CONTAINER AND CLOSURE WITH SEALING THREADS

[75] Inventor: Livinus E. M. J. Mannaerts, Kapellen, Belgium

[73] Assignee: Koninklijke Emballage Industrie Van Leer B.V., Amstelveen, Netherlands

[22] Filed: Dec. 11, 1975

[21] Appl. No.: 639,978

Related U.S. Application Data

[63] Continuation of Ser. No. 425,821, Dec. 18, 1973, abandoned.

[30] Foreign Application Priority Data

Dec. 18, 1972 Germany ..... 2261982

[52] U.S. Cl. ..... 220/288; 220/304

[51] Int. Cl.² ..... B65D 41/04

[58] Field of Search ..... 220/288, 304; 215/330; 285/189, 201, 202, 219; 85/32 V; 151/22

[56] References Cited

UNITED STATES PATENTS

| | | | |
|---|---|---|---|
| 226,450 | 4/1880 | Ibbotson | 85/32 V |
| 1,172,427 | 2/1916 | Carlson | 85/32 V |
| 2,177,005 | 10/1939 | Purtell | 151/22 |
| 2,581,690 | 1/1952 | Moehle | 151/22 |
| 3,027,042 | 3/1962 | Graves | 220/304 |
| 3,176,746 | 4/1965 | Walton | 151/22 |
| 3,297,213 | 1/1967 | Henderson | 220/288 |
| 3,410,440 | 11/1968 | Thomas | 220/296 |
| 3,426,642 | 2/1969 | Phipard | 151/22 |
| 3,517,717 | 6/1970 | Orlomoski | 151/22 |
| 3,682,345 | 8/1972 | Baugh | 215/330 |

FOREIGN PATENTS OR APPLICATIONS

| | | |
|---|---|---|
| 2,143,801 | 9/1971 | Germany |

*Primary Examiner*—Ro E. Hart

*Attorney, Agent, or Firm*—Stevens, Davis, Miller & Mosher

[57] ABSTRACT

A container made of synthetic material including a filling hole having an essentially cylindrical neck and a closure device which has a portion extending into the neck in which the portion has a sealing ring. The closure device is threaded for engaging threads of the neck, with the sealing ring being positioned between the neck and the closure device. At least one radially directed bar or rib is present in the thread of the closure device, the bar sealing completely the play between the threads of the closure device and the threads of the neck.

6 Claims, 3 Drawing Figures

CONTAINER AND CLOSURE WITH SEALING THREADS

This is a continuation of application Ser. No. 425,821 filed Dec. 18, 1973 now abandoned.

The present invention relates to a container, particularly a container made of synthetic material or to a container coated inside with synthetic material, the container having a filling-hole with an essentially cylindrical neck and a closing device, the closure having a portion extending into the neck, the portion having a sealing ring, in which the closure with a thread may engage with the thread of the neck, and in which the sealing ring is positioned between the neck and the closure. A container of this kind is known from the German Patent Application No. 2143801.7 laid open to public inspection. A disadvantage of the known container is that the liquid contained in the container may creep upwards in the thread between the neck and the closure and may come in contact with the sealing ring.

With aggressive fluids in particular, this means that the sealing ring should meet high demands so that said ring must be made from expensive material.

It is the object of the present invention to eliminate said disadvantage.

In accordance, with the invention, said object is achieved in that at least one radially directed bar or rib is present in the thread of the closure, said bar sealing completely the play between the thread of the closure and the thread of the neck. With said bar or rib it is achieved that the liquid contained in the container cannot come in contact any longer with the sealing ring. As a result thereof the sealing ring may be made from considerably less expensive material.

An additional disadvantage of the known container is that after the filling with e.g. adhesive fluids it is found often that one runs into difficulties in removing the closure.

In accordance with the invention, said drawback is eliminated in that the bar is positioned at the end of the thread of the closure facing the contents of the container. In this embodiment the bar will clean the thread in the neck of the container of any liquid present on said thread during the screwing-in of the closure.

Moreover, the bar may consist of two or more parts being slightly displaced in circumferential direction, said parts being connected to each other. This connection does increase the flexibility of the bar.

In accordance with a preferred embodiment the bar comprises two parts, one part of which connects to the core of the thread of the closure and the other part to the bottom side of the thread and both parts are bevelled at opposite sides.

For reasons of manufacture, generally two bars will be arranged diametrically opposite to each other in the thread of the closure according to a mid-section plane of the closure.

The invention will now be described more in detail in a preferred embodiment with reference to the accompanying drawings, wherein.

Figure 1:
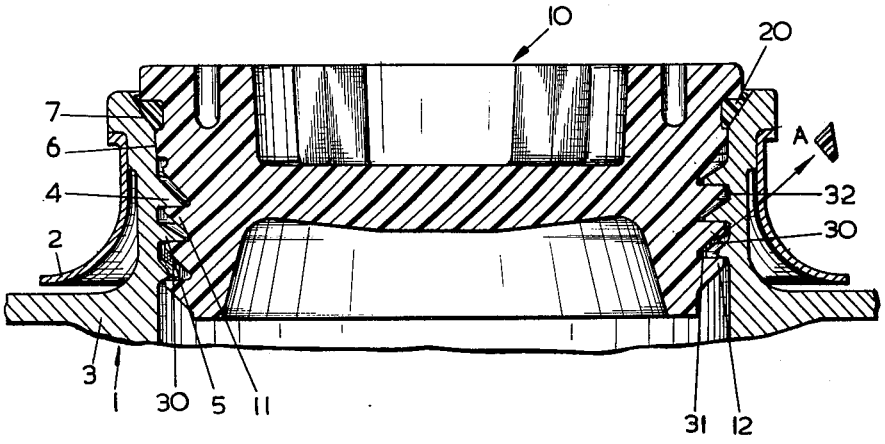
FIG. 1 illustrates one part of the container with the filling-hole and the closing device.

The container is generally indicated by reference numeral 1 and consists of a metal wall 2 with an inner coating 3 of synthetic material. Said coating forms a cylindrical neck 4 which is internally provided with thread 5. A closure 10 is present in neck 4 of the container 1. Said closure 10 has a cylindrical jacket portion 11, said portion being externally provided with thread 12. A sealing ring 20 has been provided in this embodiment. The sealing comprises in addition two truncated cone surfaces 6 and 7. Two bars 30 have been provided at two points diametrically opposite each other in thread 12 of the closure 10. Each bar comprises two portions 31 and 32, in which part 31 connects to the cylindrical core of the thread and the other part 32 to the tapered bottom side of the thread. Arrow A in FIG. 1 shows a sectional area of part 32 of bar 30 on an enlarged scale. Both parts 31 and 32 are staggered slightly in circumferential direction relatively to each other and they are connected to each other at the transition point between core and underside of the thread. Since both parts are displaced with reference to each other, their area of contact is very small. As a result thereof, they do not obstruct each other as to the flexibility.

Figure 2:
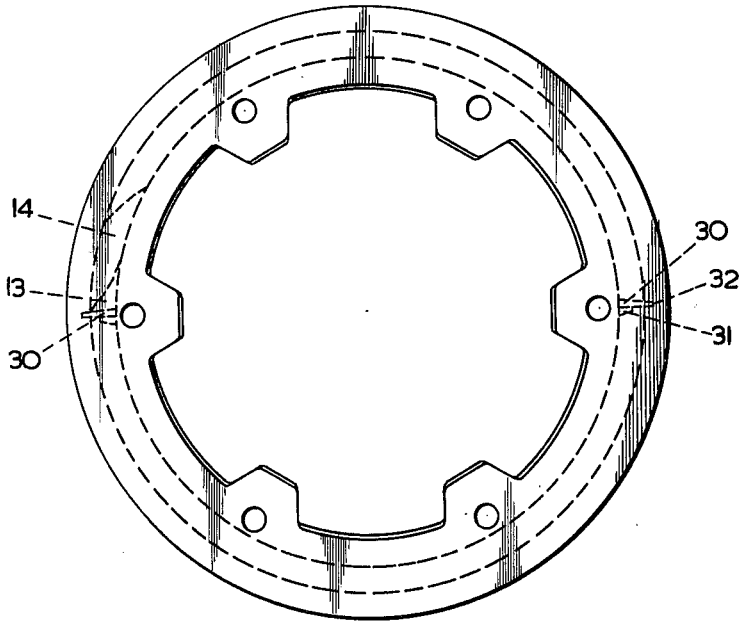
FIG. 2 illustrates a top view of the closing device in accordance with FIG. 1.

FIG. 2 illustrates the beginning of thread 12 at the top edge of the closure by reference numeral 13 and the and of thread 12 at the underside of the closure 10 is indicated by reference numeral 14. It will be evident from FIG. 2 that the bar 30, which is present in the thread chamfer of the closure 10, has been positioned at some distance from the end 14 of the thread in such a manner that the bar 30 can fulfill its sealing function.

Figure 3:
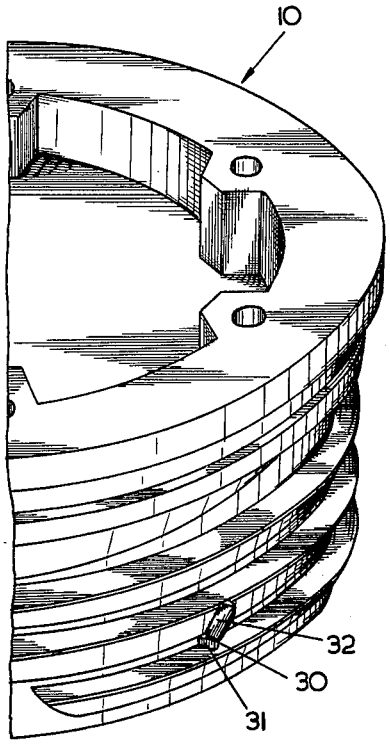
FIG. 3 gives a perspective view of part of the closing device.

A perspective view of the position of the bar 30 with the parts 31 and 32 is given in FIG. 3. In observing said Figure it will be evident that during the screwing-in of the closure 10 to the right with a right-hand thread the bar 30 will wipe-off the thread in the neck of the container and, as a result thereof, will clean said thread.

In accordance with another preferred embodiment of the invention the bar 30 will act together with thread 12 according to FIGS. 1 and 3.

I claim:

1. A container with a closure, said container comprising a cylindrical neck having internal screw threads, a closure plug having external screw threads, each of said external threads including an inclined face, a horizontal face and a cylindrical core face connecting said inclined face and said horizontal face, said plug being screwable with its external screw threads into or out of respectively the internal screw threads of the neck, a sealing ring between said neck and an outer end of the plug, said internal and external screw threads being in direct engagement over one part of the horizontal face and having play between the internal screw threads and the inclined face, the core face and the other part of the horizontal face of the external screw threads, said external screw threads near an inner end of the plug being provided with a first radially directed flexible bar which extends over the full width of faces which have play with the internal screw threads so as to completely seal the play.

2. A container with a closure according to claim 1, wherein said bar comprises two parts which are connected to each other and staggered relative to each other in the circumferential direction of said external threads.

3. A container with a closure according to claim 1, wherein said bar comprises two parts which are bevelled at opposite sides, one of said parts being connected to the core face of the external threads and the other being connected to the inclined face of said external threads.

4. A container with a closure according to claim 1, further comprising a second radially directed flexible bar on said external threads and arranged diametrically opposite said first bar with respect to a mid-section plane of said plug, said second bar extending over the full width of faces which have play with the internal screw threads so as to completely seal said play.

5. A container with a closure according to claim 1, wherein said container is made of synthetic material.

6. A container with a closure according to claim 1, wherein said container comprises a coating of synthetic material on the inside of said container.

* * * * *